US006592290B2

(12) United States Patent
Jaszkowiak

(10) Patent No.: US 6,592,290 B2
(45) Date of Patent: Jul. 15, 2003

(54) POWER TROWEL GEARBOX

(75) Inventor: Timothy S. Jaszkowiak, Boise, ID (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 09/962,884

(22) Filed: Sep. 24, 2001

(65) Prior Publication Data

US 2002/0041792 A1 Apr. 11, 2002

Related U.S. Application Data

(60) Provisional application No. 60/239,829, filed on Oct. 11, 2000.

(51) Int. Cl.[7] ..... E01C 19/22
(52) U.S. Cl. ..... 404/112
(58) Field of Search ..... 404/112; 475/230

(56) References Cited

U.S. PATENT DOCUMENTS

| | | | | | |
|---|---|---|---|---|---|
| 3,936,212 | A | | 2/1976 | Holz, Sr. et al. | 404/112 |
| 4,046,484 | A | | 9/1977 | Holz, Sr. et al. | 404/112 |
| 4,775,306 | A | * | 10/1988 | Kikuchi et al. | 404/112 |
| 5,108,220 | A | | 4/1992 | Allen et al. | 404/112 |
| 5,238,323 | A | | 8/1993 | Allen et al. | 404/85 |
| 5,480,257 | A | * | 1/1996 | Allen | 404/112 |
| 5,584,598 | A | * | 12/1996 | Watanabe et al. | 404/112 |
| 5,613,801 | A | * | 3/1997 | Allen | 404/112 |
| 5,632,570 | A | * | 5/1997 | Balling | 404/85 |
| 5,816,740 | A | | 10/1998 | Jaszkowiak | 404/112 |
| 6,089,786 | A | * | 7/2000 | Allen et al. | 404/112 |

* cited by examiner

*Primary Examiner*—Thomas B. Will
*Assistant Examiner*—Raymond W. Addie
(74) *Attorney, Agent, or Firm*—Frank J. Dykas; Stephen M. Nipper; Derek H. Maughan

(57) ABSTRACT

A gearbox for a self-propelled power trowel for finishing a concrete surface having a rigid frame adapted to be disposed over a concrete surface, an engine assembly, at least one rotor assembly. The gearbox uses an input shaft having a first bevel gear, an intermediate shaft having a second bevel gear and a first helical gear, and an output shaft having a second helical gear to connect the engine assembly to the rotor assembly to accomplish a double reduction.

14 Claims, 6 Drawing Sheets

POWER TROWEL GEARBOX

PRIORITY

This application claims priority from co-pending provisional application serial No. 60/239,829, filed Oct. 11, 2000, bearing the same title, the disclosure of which is incorporated by reference.

DESCRIPTION

BACKGROUND OF THE INVENTION

1. Technical Field

This invention generally relates to concrete power trowels, and more particularly to transmissions and gearboxes for concrete power trowels.

2. Background

Concrete power trowels are used for finishing concrete surfaces as the concrete is curing and hardening. Power trowels come in two major types, "walk-behind" power trowels where an operator walks-behind the power trowel, and "riding" power trowels where an operator rides on the power trowel.

A typical riding power trowel is a two-rotor device, with each rotor typically having multiple troweling blades extending out in radial fashion, and usually configured such that the tips of the blades of each rotor intermesh to provide for a continuous finishing of the concrete surface below the riding trowel.

While this application, for simplicity of the reader, discusses the present invention in reference to "riding" power trowels, the teachings of this application can likewise be applied to "walk-behind" power trowels and intends to include such power trowels in the general usage of the term "power trowel."

A typical power trowel has a rigid frame housing at least one blade assembly, and an engine. The engine is usually a gasoline or diesel engine, and is used to provide the motive power for the blade assembly. Other potential "engines" include, but are not limited to electric motors and hydraulic motors. For "riding" models, atop of the engine and the frame assembly is found an operator's seat and the necessary control systems and levers for operation of the trowel. These machines are manufactured in a variety of sizes and weights, with the largest of these machines having not just two, but rather three, rotor and troweling blade assemblies.

While this application, in general, refers two rotor trowels, it is intended that the teachings of this application be equally applicable to any power trowels having one or more rotors.

Typically, in riding power trowels, the engine drives a horizontal drive line or shaft which extends between a first reduction gearbox and a second reduction gearbox. In the prior art, these reduction gearboxes utilize a worm gear on the horizontal drive line which cooperates with a mating gear on a rotor shaft to accomplish the reduction.

Examples of such riding power trowels can be found in U.S. patents to Holz, Sr. et al., U.S. Pat. Nos. 3,936,212, issued Feb. 3, 1976, and 4,046,484, issued Sep. 6, 1977. Additional examples of these prior art machines are disclosed in U.S. patents to Jaszkowiak, U.S. Pat. No. 5,816,740, issued Oct. 6, 1998, and Allen et al., U.S. Pat. Nos. 5,108,220 issued Apr. 28, 1992 and 5,238,323 issued Aug. 24, 1993.

A problem which exists in these prior art examples lies in the high amount of heat generated through use of such a gear arrangement. What is needed is a transmission/gear box for a power trowel which is mechanically more efficient, thereby reducing friction and heat within the gearbox and transmitting more power to the rotor assemblies. The present invention solves this problem.

SUMMARY OF THE INVENTION

One embodiment of the present invention is an improved self propelled power trowel for finishing a concrete surface. This improved power trowel has a rigid frame means which is adapted to be disposed over the concrete surface. The trowel has an engine assembly attached to the frame means for powering the power trowel. The engine assembly also has a clutch having an upper pulley which cooperates with a belt to drive a lower pulley located on or attached to a drive shaft, thereby rotating the drive shaft.

This embodiment of trowel has a left rotor assembly and a right rotor assembly for frictionally contacting the concrete surface and supporting the frame means there-above. These rotor assemblies are tiltably connected to the frame means and are operably connected to the engine assembly through use of a transmission system. The transmission system transmits the rotation of the engine (through use of the drive shaft) to the rotor assemblies. The transmission system further comprises a drive shaft, a first gearbox attached to the rigid frame means, and a second gearbox attached to the rigid frame means.

The drive shaft has a lower pulley for cooperating with the belt, a drive shaft first end cooperating with a first (or left) input shaft, and a drive shaft second end cooperating with a second (or right) input shaft. The first gearbox has a first housing having a first side opening and a first bottom opening. The first side opening receives therethrough the first input shaft. The first bottom opening receiving therethrough the first output shaft. The first input shaft connects to the drive shaft first end, and further to a first bevel gear for intermeshing cooperation with a second bevel gear located on a first intermediate shaft.

The first intermediate shaft has a first helical gear and the aforementioned second bevel gear. The first intermediate shaft is preferably oriented generally perpendicular to the first input shaft. The first helical gear being formed for intermeshing cooperation with a second helical gear located on the first output shaft. The first output shaft has the second helical gear, and is able to cooperate with the first rotor assembly to transfer the rotation of said first output shaft (ultimately driven by the drive shaft/engine) to the rotation of the first rotor assembly.

The right gearbox has a housing having a second side opening and a second bottom opening. The second side opening receives therethrough the right input shaft. The second bottom opening receives therethrough a right output shaft. The right input shaft connects to the drive shaft second end, and has a third bevel gear for intermeshing cooperation with a fourth bevel gear located on a right intermediate shaft.

The right intermediate shaft has a third helical gear and a fourth bevel gear. The right intermediate shaft is oriented generally perpendicular to the right input shaft. The third helical gear being formed for intermeshing cooperation with a fourth helical gear located on the right output shaft. The right output shaft has a fourth helical gear, and is for cooperating with the right rotor assembly to transfer the rotation of the right output shaft to the rotation of the right rotor assembly.

A second embodiment is a transmission system for a self propelled power trowel for finishing a concrete surface. This power trowel has: a rigid frame means adapted to be disposed over a concrete surface; an engine assembly for powering a power trowel attached to a frame means, wherein the engine means further comprises a clutch having an upper pulley which cooperates with a belt to drive a lower pulley located on a drive shaft; a left rotor assembly and a right rotor assembly for frictionally contacting the concrete surface and supporting the frame means thereabove, tiltably connected to the frame means and operably connected to the engine assembly through a transmission system for transmitting the rotation of the engine means to the rotor assemblies.

This embodiment's transmission system has a drive shaft having a first end extending to at least one gearbox. The drive shaft further having at least one lower pulley able to cooperate with the belt of said engine assembly to be rotated and to rotate the drive shaft. The drive shaft first end attaches to an input shaft extending from the gearbox.

The transmission system further has a gearbox having a housing having a top, a bottom, at least one side wall, a side wall opening through the side wall, and a bottom opening through the bottom. The gearbox has a generally horizontal input shaft extending through the side wall opening. This input shaft having a first end and a second end. The input shaft second end being located outside of the housing and operably attaching to the drive shaft at the drive shaft's first end. The input shaft first end further comprising a bevel gear.

The gearbox further has a generally vertical intermediate shaft rotatably mounted inside the housing, this intermediate shaft having a first end and a second end. The first end having a second bevel gear for intermeshing cooperation with the first bevel gear, and the second end having a first helical gear. The gearbox further has a generally vertical output shaft extending through the bottom opening, this output shaft having a first end and a second end. The second end being located outside of the housing and operably attaching to a rotor assembly. The first end being rotatably mounted within the housing. The output shaft having a second helical gear adjacent to the second end, this second helical gear for intermeshing cooperation with the first helical gear. It should be noted that the above-referenced helical gears could just as easily be spur gears, herring bone gears, or any other type of gear that transmits power in a similar manner. It should also be noted that the above-referenced bevel gears could be spiral-bevel gears, or any other type of gear that transmits power in a similar manner.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

BEST MODE FOR CARRYING OUT INVENTION

Figure 1:
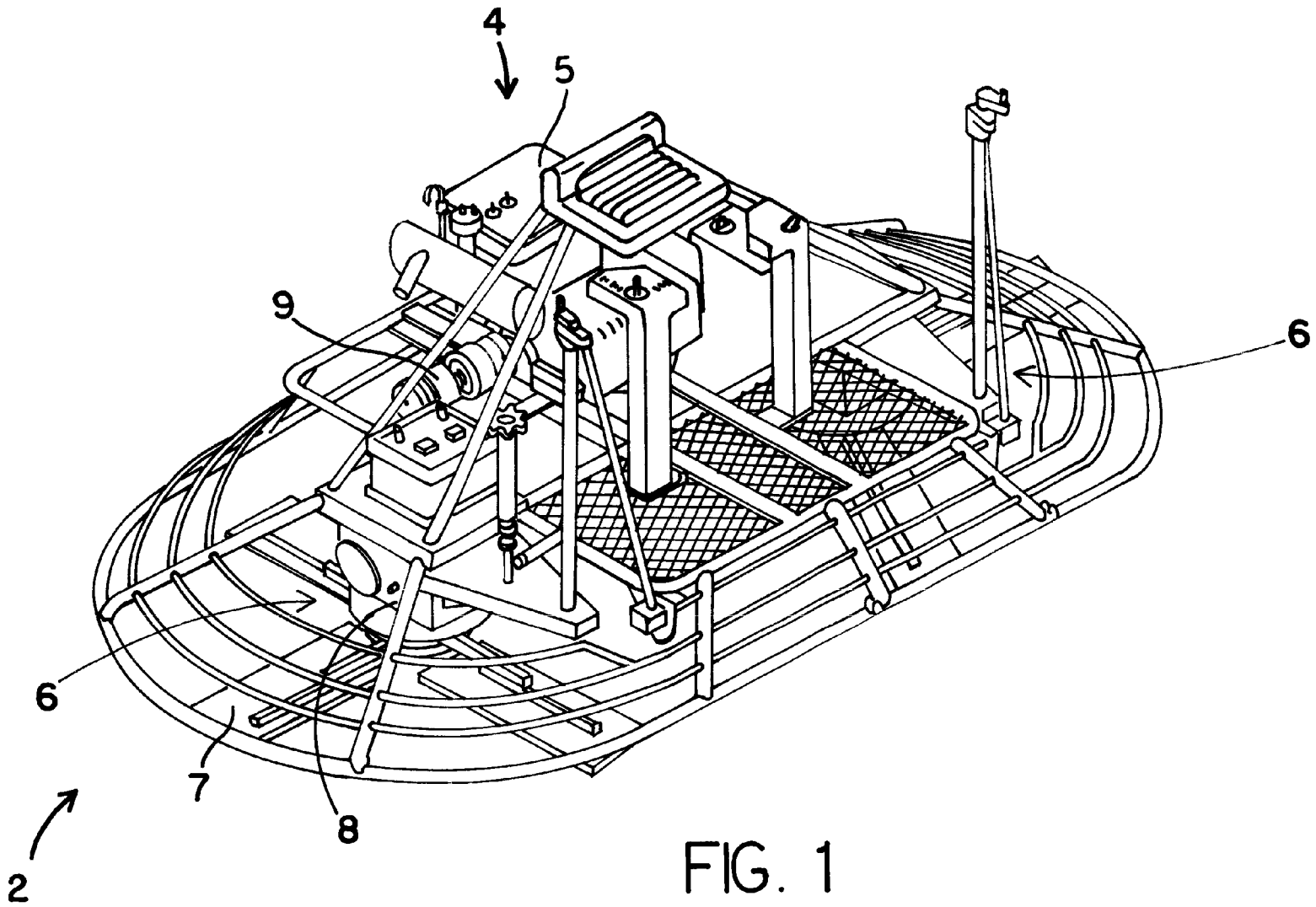
FIG. 1 is a perspective view of a two-rotor power trowel.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring initially to FIG. 1, shown is a perspective view of a two-rotor riding power trowel on which the present invention could be used. The power trowel 2 is formed of basic sub-assemblies, including a rigid frame 3, an engine assembly 4, an operator seat 105, and at least one rotor assembly 6, all of which are well known in the art.

Figure 2:
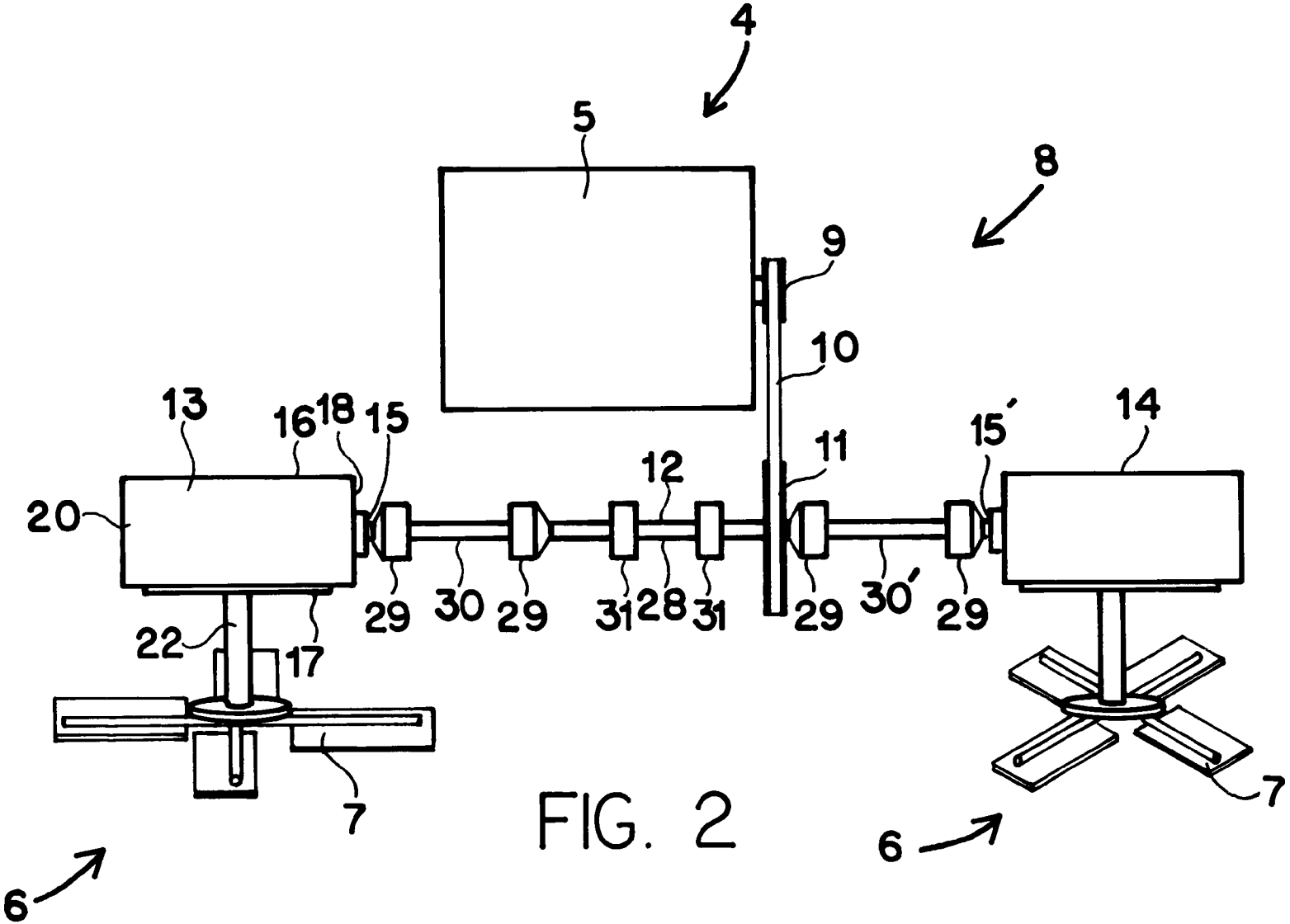
FIG. 2 is a rear, schematic representational drawing of a first embodiment of the invented transmission system for power trowels.

Referring now to FIG. 2, one embodiment of the present invention is shown. In this Figure, the invented power trowel improvement utilizes a transmission system 8 for transmitting the rotation of the engine 5 of the engine assembly 4 to the rotors 7 of the rotor assembly(ies) 6. In the improved transmission system 8, the engine 5, through use of a clutch and upper pulley 9, drives a belt 10 which extends to a lower pulley 11 located on a drive shaft 12. This drive shaft or drive line 12 extends between a pair of reduction gearboxes, namely a first gearbox 13 and a second gearbox 14. Thus, the rotation of the engine 5 rotates the belt 10 which rotates the lower pulley 11 which rotates the drive shaft 12. Any engagement device can be utilized in place of the clutch.

Each gearbox 13, 14 is substantially the same aside from the input shaft entering the gearbox from opposite sides of the gearbox and opposite directions of rotation. As a result, the gearboxes 13, 14 are mirror images of one another. For this reason, the below discussion of the first (or left) gearbox 13 equally applies to the second (or right) gearbox 14.

The gearbox 13 comprises a box-like housing 20 having a top 16, a bottom 17, and at least one side wall 18. Openings are located in the bottom and one of the side walls. The bottom opening (not shown) receives therethrough the output shaft 22 which extends to and drives the rotor assembly 6. The side wall opening (not shown) receives the input shaft 15 which is driven by the drive shaft 12 and engine 5. The input shaft 15 and the output shaft 22 are connected in driving relationship so that rotation of the engine 5 results in rotation of the rotor assembly 6 attached to the output shaft 22.

Figure 3:
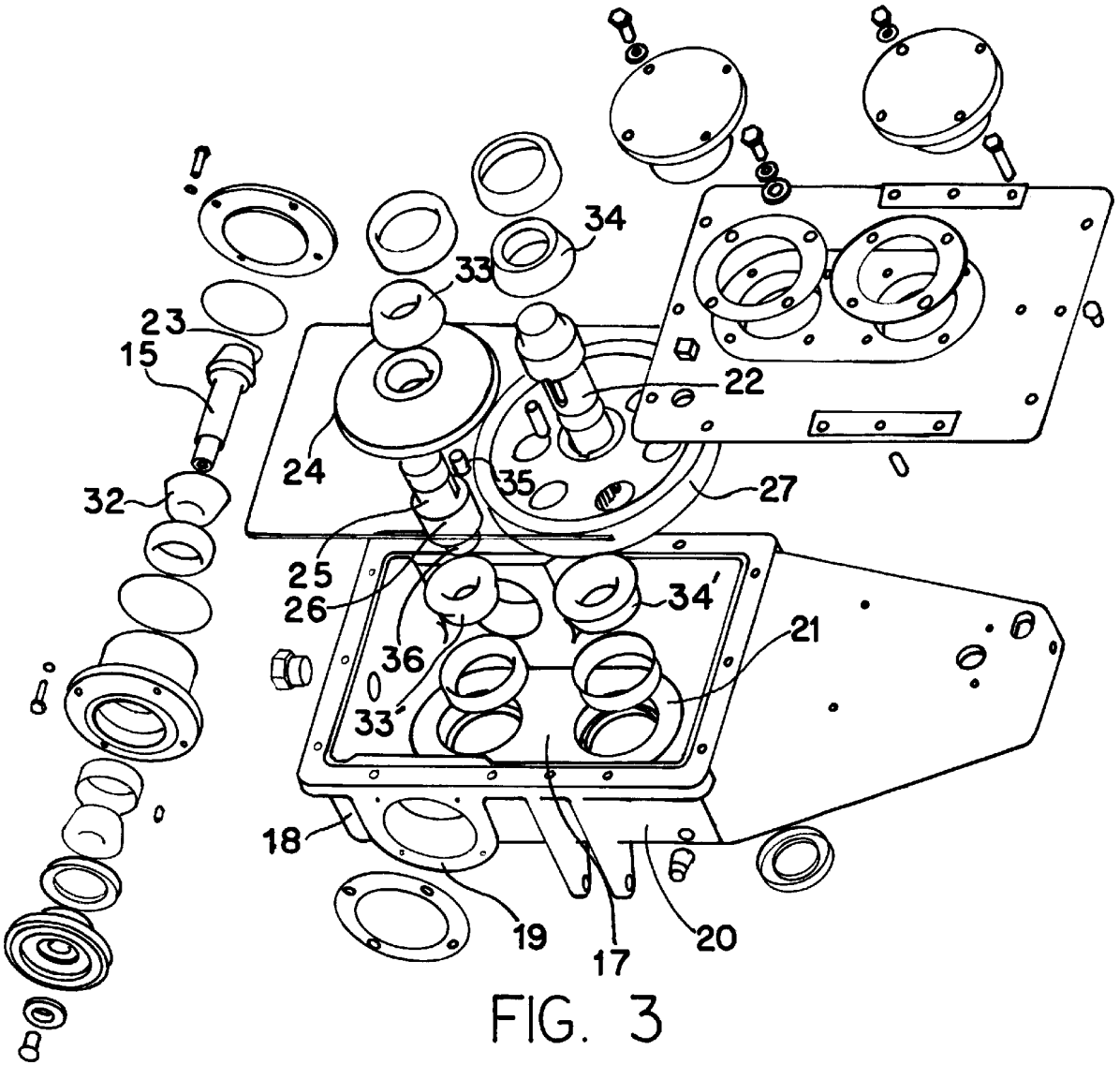
FIG. 3 is an exploded, perspective, view of a second embodiment of the present invention.

Referring now to FIG. 3, the input shaft 15 extends through the side wall opening 19 and is preferably mounted within the housing 20 on a tapered roller bearing 32 supported in the side wall 18. The end of the input shaft 15 adjacent the side wall 18 receives a first bevel pinion gear 23. In the preferred embodiment, this first bevel pinion gear 23 is formed onto the input shaft 15. However, it would also be able to attach such a gear to a shaft in standard manners known to the art, including, but not limited to: key and slot connections, threads and nuts, pressed on gears, keyless tapered hubs, splined shafts and gears, etc. Any of the gears in this invention can be attached to their respective shafts in any of these manners.

Figure 4A:
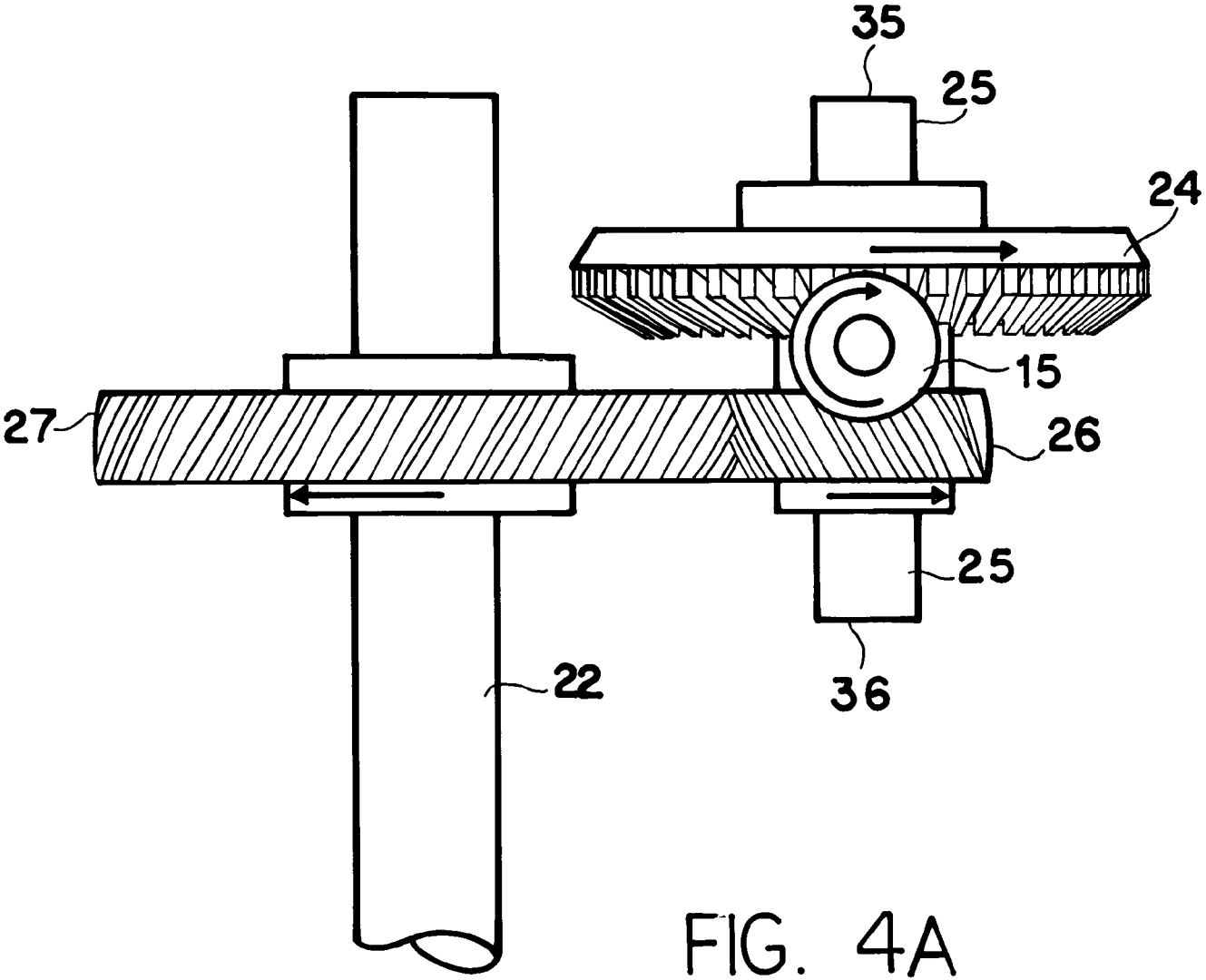
FIG. 4A is a partial, side perspective view of a third embodiment of the present invention.
Figure 4B:
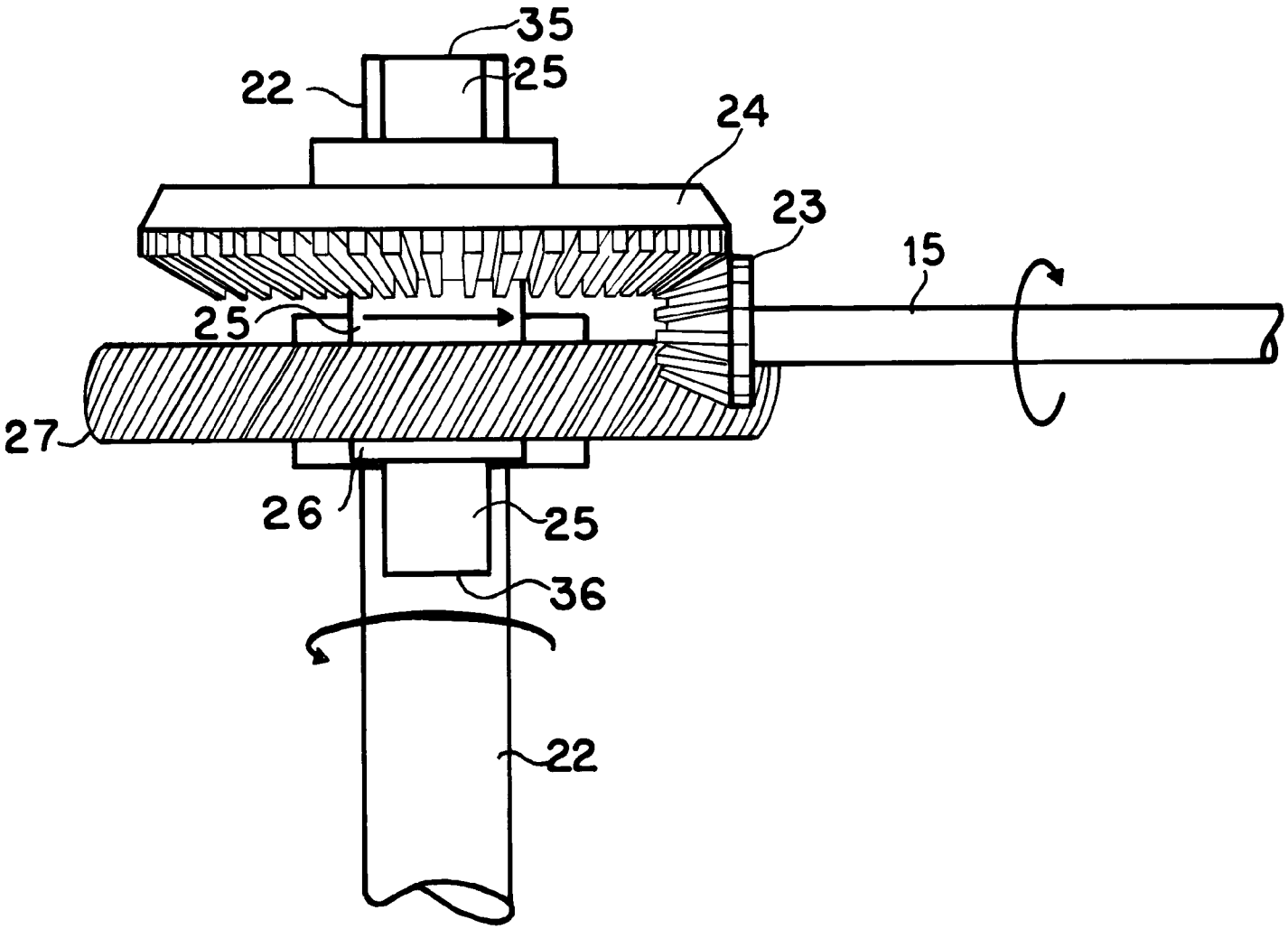
FIG. 4B is a partial, side perspective view of the embodiment shown in FIG. 4A.

An intermediate shaft 25 is rotationally mounted within the housing on tapered roller bearings 33, 33' supported generally perpendicular to the input shaft 15. Referring now to FIGS. 4A and 4B, the intermediate shaft 25 has a first end 35 and a second end 36. The intermediate shaft first end 35 receives a second bevel gear 24 which is preferably held thereon by standard key and slot connection. This second bevel gear 24 is formed to intermesh with the first bevel gear 23 so that rotation of the drive shaft rotates the input shaft 15 which rotates the first bevel gear 23 and thereby rotates the second bevel gear 24 and attached intermediate shaft 25.

The intermediate shaft second end 36 receives a first pinion helical gear 26, preferably formed onto the intermediate shaft 25. This first pinion helical gear 26 is formed to intermesh with a second helical gear 27 located on the output shaft 22.

Figure 5:
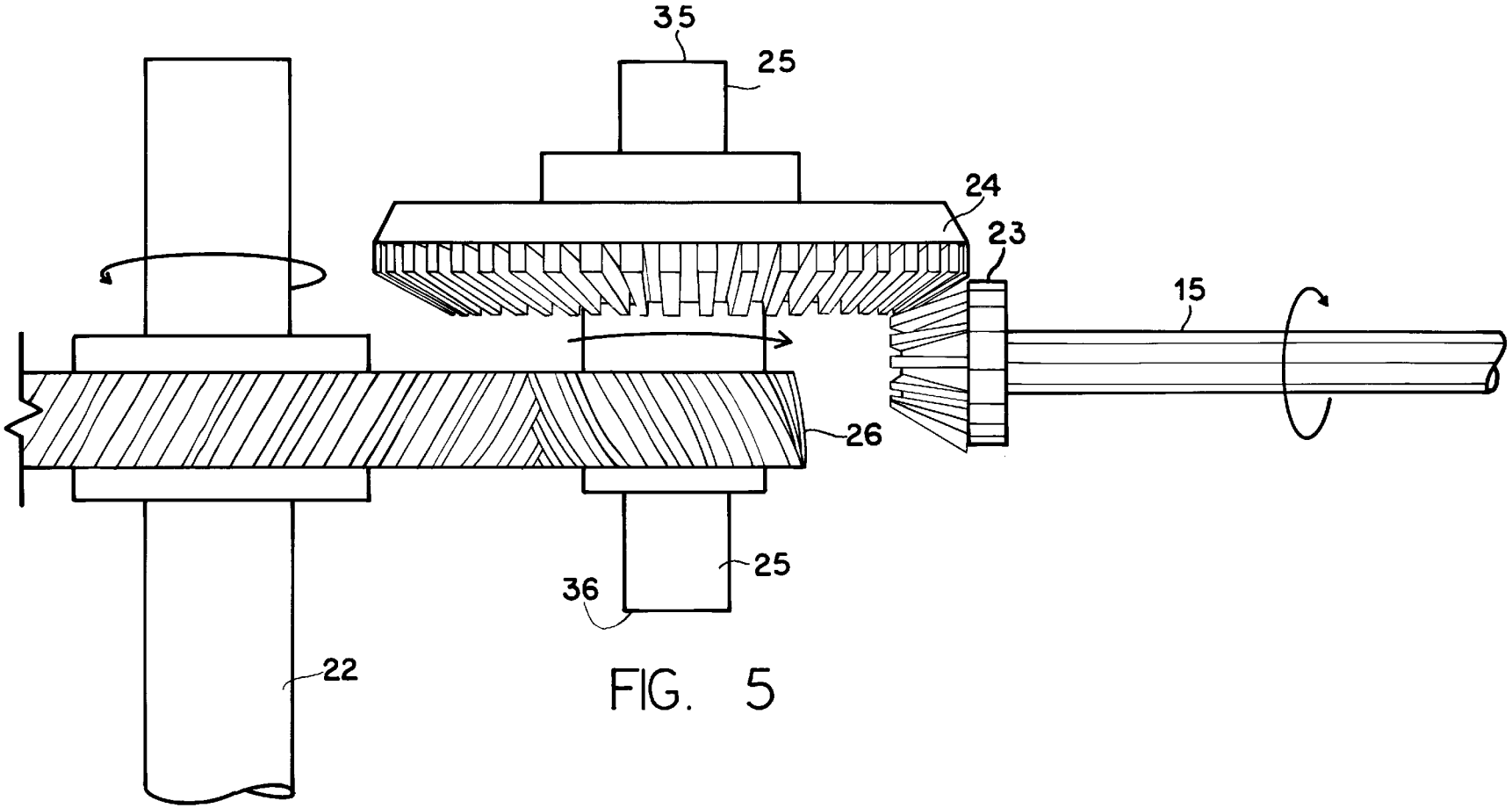
FIG. 5 is a partial, side perspective view of a fourth embodiment of the present invention, shown with the input shaft rotated into view.

Referring now to FIG. 5, FIG. 5 shows a side view of one embodiment of the present invention, similar to the view shown in FIG. 4A but with the input shaft 15 and first bevel pinion gear 23 rotated around the figure so that the gearing can be easily seen. While this gearing of FIG. 4A is preferred, other gearings, as well as angles of gearing arrangements (as shown in FIG. 5) are also envisioned.

Referring back to FIG. 3, extending into the housing 20 through the bottom opening 21 is an output shaft 22. The output shaft 22 is mounted within the housing 20 on tapered roller bearings 34, 34' supported in the bottom 17. The output shaft 22 adjacent the bottom 17 receives a second helical gear 27 which is preferably held thereon by a standard key and slot connection. The output shaft 22 is preferably generally parallel to the intermediate shaft 25, and perpendicular to the input shaft 15. The output shaft 22 is able to drivingly connect to the rotor assembly.

This second helical gear 27 is formed to intermesh with the first helical gear 26 so that rotation of the drive shaft 12 rotates the input shaft 15 which rotates the first bevel gear 23, thereby rotating the second bevel gear 24 and attached intermediate shaft 25, rotating the second helical gear 27 and attached output shaft 22 which cooperates to result in rotation of the rotor assembly. Thereby, the rotation of the drive shaft or drive line 12 is translated into a generally right-angled rotation of the rotor shaft (output shaft) 22.

Referring back to FIG. 2, in one embodiment, the drive shaft or line 12 preferably comprises three segments. The first segment 28 attaches to the lower pulley 11 for cooperation with the drive belt 10 extending from the engine assembly 4. While this application refers to pulleys and belts, other methods of transmission of the engine's rotation is also intended to be included, including, but not limited to: gears, chains, and other means. This first or primary segment 28 is supported through use of a pair of pillow block bearings 31.

This first (primary) 28 segment has a first end and a second end. Each of these ends attach at a constant velocity (CV) joint 29 to secondary segments 30, 30'. Each of these secondary segments 30, 30' attach at CV joints 29 to the input shafts 15, 15'(first and second) which extend into the gearboxes 13, 14.

The invented transmission system double reduction gearbox is able, based upon the gearing used, to accomplish any desired reduction ratio. Preferred ratios include around 19:1, 20:1, 25:1 and 50:1.

Other alternative embodiments include switching the location of the helical and bevel gears in the preferred embodiment so that generally horizontal input shaft first end further comprising a helical gear, the intermediate shaft first end having a second helical gear, the intermediate shaft second end having a first bevel gear, and the output shaft having a second bevel gear adjacent its second end. Likewise, an embodiment could use two pairs of bevel gears. Yet another embodiment could replace the intermeshing gears on the intermediate shaft and the output shaft with pulleys and a belt or sprocket gears and a chain. Likewise, it should be noted that helical gears could just as easily be spur gears, herringbone gears, or any other type of gear that transmits power in a similar manner. It should also be noted that the above-referenced bevel gears could be spiral-bevel gears, or any other type of gear that transmits power in a similar manner.

While there is shown and described the present preferred embodiments of the invention, it is to be distinctly understood that this invention is not limited thereto but may be variously embodied to practice within the scope of the following claims. From the foregoing description, it will also be apparent that various changes may be made without departing from the spirit and scope of the invention as defined by the following claims.

I claim:

1. A power trowel for finishing a concrete surface, said power trowel comprising:

a rigid frame assembly adapted to be disposed over said concrete surface;

an engine assembly for rotating a drive shaft, said engine assembly attaching to said frame assembly;

at least one rotor assembly for frictionally contacting said concrete surface and supporting said frame assembly above said concrete surface, said rotor assembly tiltably connected to said frame assembly and operably connected to said engine assembly through use of a transmission system for transmitting rotation of said drive shaft to said rotor assembly; and at least one transmission system comprising said drive shaft and at least one gearbox attached to said rigid frame assembly, wherein said gearbox comprises an input shaft having a first bevel gear for intermeshing cooperation with a second bevel gear of an intermediate shaft located within said gearbox, said intermediate shaft further comprising a first helical gear, said first helical gear formed for intermeshing cooperation with a second helical gear located on an output shaft, said output shaft further comprising said second helical gear, said output shaft for cooperating with said rotor assembly to transfer the rotation of said drive shaft to the rotation of said rotor assembly.

2. The power trowel of claim 1, wherein the transmission system further comprises a housing having a side opening and a bottom opening.

3. The power trowel of claim 2, wherein said side opening receives therethrough said input shaft and wherein said bottom opening receives therethrough said output shaft, said input shaft drivingly connecting to said drive shaft, said output shaft drivingly connected to said rotor assembly.

4. The power trowel of claim 1, wherein the number of rotor assemblies is two.

5. The power trowel of claim 4, wherein the number of transmission systems is two.

6. The power trowel of claim 1, wherein the engine assembly further comprises a clutch having an upper pulley which cooperates with a belt to drive a lower pulley located on said drive shaft.

7. The power trowel of claim 1, wherein said first intermediate shaft is oriented generally perpendicular to said input shaft.

8. A power trowel for finishing a concrete surface, said power trowel comprising:

a rigid frame assembly adapted to be disposed over said concrete surface;

an engine assembly attached to said frame means for powering said power trowel by driving a drive shaft;

a first rotor assembly and a second rotor assembly for frictionally contacting said concrete surface and supporting said frame assembly there-above, said rotor assemblies tiltably connected to said frame assembly and operably connected to the engine assembly through use of a transmission system for transmitting rotation of said drive shaft to said rotor assemblies;

a transmission system comprising said drive shaft, a first gearbox attached to said rigid frame assembly, and a second gearbox attached to said rigid frame assembly;

wherein said drive shaft comprises a drive shaft first end driving a first input shaft, and a drive shaft second end driving a second input shaft;

wherein said first gearbox comprises a first housing having a first side opening and a first bottom opening, wherein said second side opening receives therethrough said first input shaft and wherein said first bottom opening receives therethrough a first output shaft; wherein said first input shaft drivingly connects to said drive shaft first end, said first input shaft further comprising a first bevel gear for intermeshing cooperation with a second bevel gear located on a first intermediate shaft; wherein said first intermediate shaft further comprises a first helical gear and said second bevel gear, said first intermediate shaft oriented generally perpendicular to said first input shaft, said first helical gear formed for intermeshing cooperation with a second helical gear located on said first output shaft; wherein said first output shaft further comprises said second helical gear, said first output shaft for cooperating with said first rotor assembly to transfer the rotation of said drive shaft to the rotation of said first rotor assembly; and wherein said second gearbox comprises a second housing having a second side opening and a second bottom opening, wherein said second side opening receives therethrough said second input shaft and wherein said second bottom opening receives therethrough a second output shaft; wherein said second input shaft drivingly connects to said drive shaft second end, said second input shaft further comprising a third bevel gear for intermeshing cooperation with a fourth bevel gear located on a second intermediate shaft; wherein said second intermediate shaft further comprises a third helical gear and said fourth bevel gear, said second intermediate shaft oriented generally perpendicular to said second input shaft, said third helical gear formed for intermeshing cooperation with a fourth helical gear located on said second output shaft; wherein said second output shaft further comprises said fourth helical gear, said second output shaft for cooperating with said second rotor assembly to transfer the rotation of said drive shaft to the rotation of said second rotor assembly.

9. The power trowel of claim 8, wherein said engine assembly further comprises a clutch having an upper pulley which cooperates with a belt to drive a lower pulley located on said drive shaft.

10. A transmission system for a power trowel for use in finishing a concrete surface, said power trowel having: a rigid frame assembly adapted to be disposed over said concrete surface; an engine assembly for powering said power trowel, said engine assembly attached to said frame assembly, said engine assembly further comprising a rotationally driven drive shaft, said drive shaft having a first end able to drivingly connect with a gearbox input shaft; at least one rotor assembly for frictionally contacting said concrete surface and supporting said frame assembly above said concrete surface, said rotor assembly tiltably connected to said frame assembly and operably connected to said engine assembly through use of said gearbox for transmitting the rotation of said engine assembly to said rotor assembly, said gearbox attached to said rigid frame assembly; wherein said gearbox comprises:

a housing having a top, a bottom, at least one side wall, a side wall opening through said side wall, and a bottom opening through said bottom;

an input shaft extending through said side wall opening, said input shaft having a first end and a second end, wherein said input shaft second end is located outside of said housing, wherein said input shaft first end further comprises a bevel gear;

an intermediate shaft rotatably mounted inside said housing, said intermediate shaft having a first end and a second end, said intermediate shaft first end further comprises a second bevel gear for intermeshing cooperation with said first bevel gear, said intermediate shaft second end further comprises a first helical gear;

a generally vertical output shaft extending through said bottom opening, said output shaft having a first end and a second end, wherein said output shaft second end is located outside of the housing, wherein said output shaft first end is rotationally mounted within said housing, wherein said output shaft further comprises a second helical gear adjacent to said second end, said second helical gear for intermeshing cooperation with said first helical gear.

11. The transmission system of claim 10, wherein said input shaft operably attaches to said drive shaft at said drive shaft first end.

12. The transmission system of claim 10, wherein said output shaft operably attaches to a rotor assembly.

13. The transmission system of claim 10, wherein said engine assembly further comprises a clutch having an upper pulley which cooperates with a belt to drive a lower pulley located on said drive shaft.

14. The transmission system of claim 10, wherein said intermediate shaft is mounted inside said housing generally perpendicular to said input shaft.

* * * * *